US012110204B2

(12) United States Patent
Tashiro

(10) Patent No.: US 12,110,204 B2
(45) Date of Patent: Oct. 8, 2024

(54) SHEET POST-PROCESSING APPARATUS, AND IMAGE FORMING SYSTEM AND ELECTRONIC APPARATUS PROVIDED THEREWITH

(71) Applicant: KYOCERA Document Solutions Inc., Osaka (JP)

(72) Inventor: Yoshiaki Tashiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 309 days.

(21) Appl. No.: 17/747,769

(22) Filed: May 18, 2022

(65) Prior Publication Data

US 2022/0371847 A1 Nov. 24, 2022

(30) Foreign Application Priority Data

May 24, 2021 (JP) ..... 2021-086746

(51) Int. Cl.

| | |
|---|---|
| ***B65H 31/18*** | (2006.01) |
| ***B65H 31/02*** | (2006.01) |
| ***B65H 31/10*** | (2006.01) |
| ***B65H 31/24*** | (2006.01) |

(52) U.S. Cl.

CPC ..... *B65H 31/18* (2013.01); *B65H 31/02* (2013.01); *B65H 31/10* (2013.01); *B65H 31/24* (2013.01); *B65H 2402/44* (2013.01); *B65H 2405/11151* (2013.01); *B65H 2405/332* (2013.01); *B65H 2801/27* (2013.01)

(58) Field of Classification Search

CPC ..... B65H 31/04; B65H 31/08; B65H 31/10; B65H 31/12; B65H 31/14; B65H 31/16; B65H 31/18; B65H 2405/35; B65H 2405/353; B65H 2402/40; B65H 2402/44; G03G 21/1619; G03G 2221/1678

See application file for complete search history.

(56) References Cited

U.S. PATENT DOCUMENTS 7,762,551 B1 * 7/2010 Wu ..... B65H 31/10 271/294

FOREIGN PATENT DOCUMENTS

JP H 06-234450 A 8/1994

* cited by examiner

*Primary Examiner* — Jeremy R Severson

(74) *Attorney, Agent, or Firm* — Stein IP, LLC

(57) ABSTRACT

A sheet post-processing apparatus includes an apparatus body, a body frame, a sheet conveyance passage, an elevating tray, and an elevating unit. The elevating unit has a pair of rails. The body frame has a plurality of vertical frame members extending in the vertical direction and horizontal frame members that extends in a horizontal direction and is joined to the plurality of vertical frame members. The pair of rails are formed integrally with, among the plurality of vertical frame members, a pair of vertical frame members provided corresponding to a second side surface.

6 Claims, 8 Drawing Sheets

SHEET POST-PROCESSING APPARATUS, AND IMAGE FORMING SYSTEM AND ELECTRONIC APPARATUS PROVIDED THEREWITH

INCORPORATION BY REFERENCE

This application is based on and claims the benefit of priority from Japanese Patent Application No. 2021-086746 filed on May 24, 2021, the contents of which are hereby incorporated by reference.

BACKGROUND

The present disclosure relates to a sheet post-processing apparatus, and to an image forming system and an electronic apparatus provided therewith.

Conventionally, image forming systems are known that can form images on a plurality of sheets (of a recording medium such as print paper) and then perform predetermined post-processing on a sheet bundle resulting from stacking those sheets together, thereby to produce a predetermined booklet. One known such image forming system includes an image forming apparatus that form images on sheets and a sheet post-processing apparatus connected to the downstream side of the image forming apparatus in the sheet conveyance direction. The sheet post-processing apparatus here receives sheets discharged from the image forming apparatus, and performs predetermined post-processing on them (as by stacking together a plurality of sheets so received to form a sheet bundle and performing a binding process to bind the sheet bundle with a staple or a punch hole forming process to perforate the sheet bundle with a punch hole forming device.

Such a sheet post-processing apparatus has a frame member that constitutes the skeleton of its housing. In the sheet post-processing apparatus, individual devices constituting it (such as a stapling device and a punch hole forming device) are fastened to the frame member. Also side panels, a bottom panel, a top panel, and the like that constitute the housing of the sheet post-processing apparatus are fastened to the frame member. The frame member is composed of a combination of metal plate-form members (sheet-metal members).

SUMMARY

According to one aspect of the present disclosure, a sheet post-processing apparatus receives a sheet discharged from an upstream apparatus and performs predetermined post-processing on the sheet. The sheet post-processing apparatus includes an apparatus body, a body frame, a sheet conveyance passage, an elevating tray, and an elevating unit. The elevating unit is provided on the body frame, and includes a pair of rails that guide the ascent and descent of the elevating tray. The body frame constitutes the frame of the apparatus body. Through the sheet conveyance passage, the sheet is conveyed from a carry-in port provided in a first side surface of the apparatus body to a carry-out port provided in a second side surface of the apparatus body opposite from the first side surface. The elevating tray configured to ascend and descend along the second side surface, and on the elevating tray, the sheet discharged from the carry-out port is stacked. The elevating unit that makes the elevating tray ascend and descend. The pair of rails are provided on the body frame and guide the ascent and descent of the elevating tray. The body frame includes of a plurality of vertical frame members that extends in the vertical direction and a plurality of horizontal frame members that extends in a horizontal direction and is joined to the plurality of vertical frame members. The pair of rails are formed integrally with, among the plurality of vertical frame members, a pair of vertical frame members provided corresponding to the second side surface.

DETAILED DESCRIPTION

Hereinafter, with reference to the accompanying drawings, an embodiment of the present disclosure will be described. First, with reference to FIG. 1, a description will be given of an image forming system 100 according to the present disclosure that includes an image forming apparatus 1 and a sheet post-processing apparatus 3. While the following description deals with a configuration that employs, as the image forming apparatus 1 in the image forming system 100, an ink-jet printer as one example, any other type of image forming apparatus (e.g., a laser printer or a facsimile machine) may be employed instead.

Figure 1:
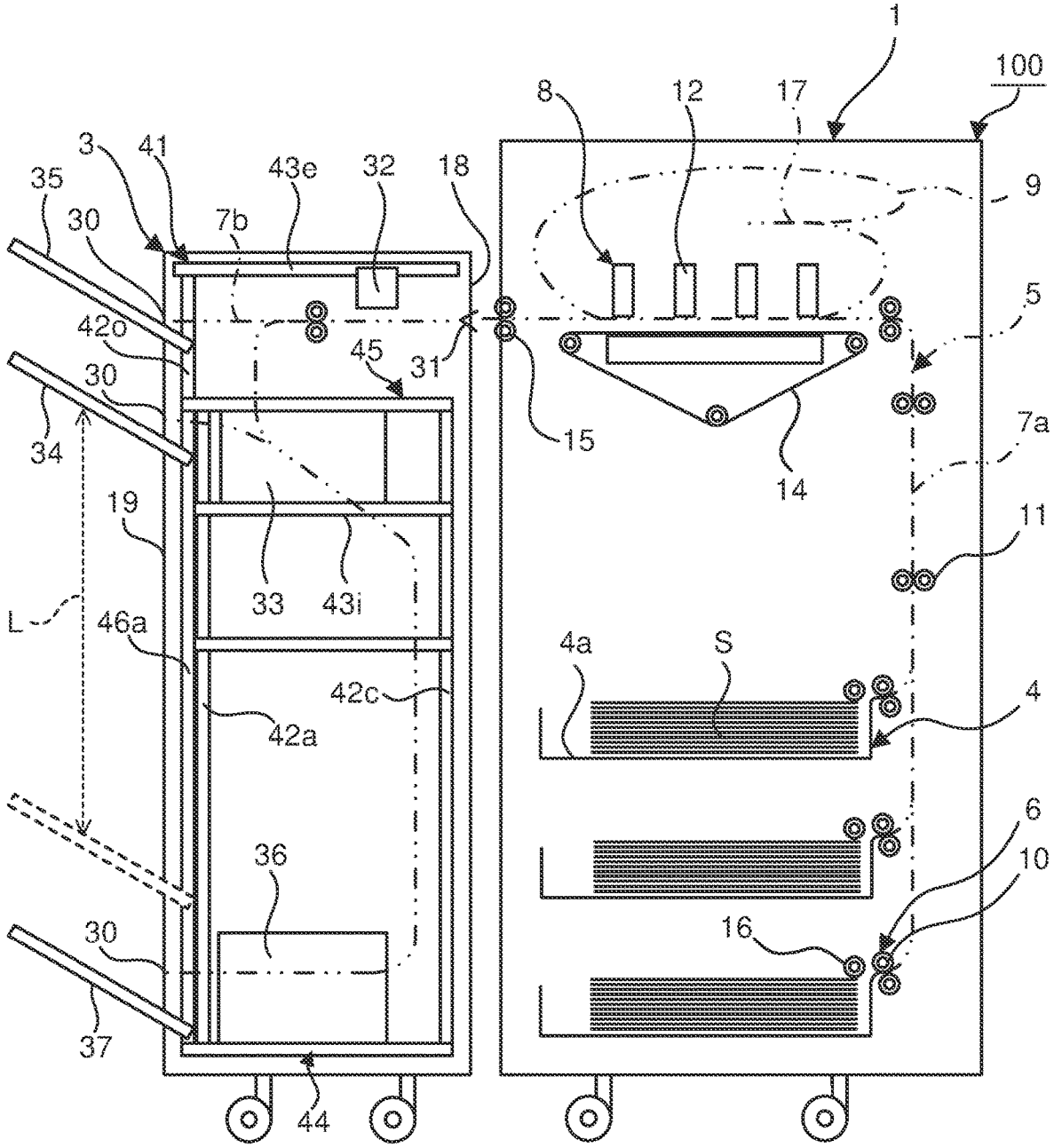
FIG. 1 is a schematic diagram showing an internal construction of an image forming apparatus and a sheet post-processing apparatus that constitute an image forming system.

FIG. 1 is a schematic diagram showing the internal construction of the image forming apparatus 1 and the sheet post-processing apparatus 3 that constitute the image forming system 100. To the downstream side of the image forming apparatus 1, the sheet post-processing apparatus 3 is connected. The image forming system 100 includes the image forming apparatus 1, which forms images on the surface of sheets S as a recording medium (such as regular paper or envelopes), and the sheet post-processing apparatus 3, which is connected to the downstream side of the image forming apparatus 1 and which performs predetermined post-processing (such as a punch hole forming process and a binding process) on sheets S discharged from the image forming apparatus 1.

In the following description, the direction in which a sheet S discharged from the image forming apparatus 1 is conveyed toward the sheet post-processing apparatus 3 will be referred to as the "sheet conveyance direction". Moreover, assuming that the sheet post-processing apparatus 3 is disposed at the downstream side in the sheet conveyance direction, the side at which a sheet storage unit 4 for storing sheets S is disposed will be referred to as the upstream side. The direction of the height of the image forming apparatus 1 will be referred to simply as the "height direction". A direction orthogonal to the height direction will be referred to as a "horizontal direction". Of different horizontal directions, the direction in which the image forming apparatus 1 and the sheet post-processing apparatus 3 are disposed side by side will be referred to as the "left-right direction", and the direction (i.e., the front-rear direction with respect to the image forming apparatus 1) orthogonal to the left-right direction will be referred to as the "front-rear direction".

The image forming apparatus 1 includes a sheet storage unit 4 in which sheets S are stored, a sheet conveyance unit 5 that feeds one sheet S after another from the sheet storage unit 4 downstream in the sheet conveyance direction, an image recording unit 8 (image forming unit) that forms an image on the surface of the sheet S conveyed, and a reversal conveyance passage 9 that receives the sheet S having passed through the image recording unit 8 and that then conveys the sheet S, with its faces reversed, back to the image recording unit 8.

The sheet storage unit 4 is located in a lower part of the image forming apparatus 1. The sheet storage unit 4 includes a plurality of sheet feed cassettes 4*a* on each of which a bundle of sheets S is stacked. Each sheet feed cassette 4*a* is removably mounted in a lower part of the image forming apparatus 1. Each sheet feed cassette 4*a* can be taken out of and put into the image forming apparatus 1 in a horizontal direction, through a side of the image forming apparatus 1.

The sheet conveyance unit 5 includes a sheet conveyance passage 7*a*, a sheet feeding unit 6, and a pair of conveyance rollers 11. The sheet conveyance passage 7*a* is connected to the sheet storage unit 4. An upstream end part of the sheet conveyance passage 7*a* branches into a plurality of paths to be connected individually to the sheet feed cassettes 4*a*. The sheet conveyance passage 7*a* extends from a side of the sheet storage unit 4 downstream in the sheet conveyance direction.

The sheet feeding unit 6 is provided at a junction between each sheet feed cassette 4*a* and the sheet conveyance passage 7*a*, and conveys a sheet S in the sheet feed cassette 4*a* into the sheet conveyance passage 7*a*. The sheet feeding unit 6 includes a pickup roller 16 and a pair of feed rollers 10.

The pickup roller 16 is provided above the sheet feed cassette 4*a*, and lies in contact with the top surface of the bundle of sheets S in the sheet feed cassette 4*a*. As the pickup roller 16 rotates, a sheet S that lies in contact with the pickup roller 16 is conveyed downstream in the sheet conveyance direction.

The pair of feed rollers 10 is provided downstream of the pickup roller 16 in the sheet conveyance direction. The pair of feed rollers 10 is a pair of roller members that are disposed opposite each other with the sheet conveyance passage 7*a* in between. The pair of feed rollers 10 are disposed opposite each other, in pressed contact with each other, to form a nip. A sheet S conveyed by the pickup roller 16 is, by being nipped at the nip between the pair of feed rollers 10, further conveyed downstream of the sheet conveyance passage 7*a*.

Actually a plurality of pairs of conveyance rollers 11 are provided at different positions along the sheet conveyance passage 7*a*. Each pair of conveyance rollers 11 is a pair of roller members that are disposed opposite each other with the sheet conveyance passage 7*a* in between. The pair of conveyance rollers 11 are disposed opposite each other, in pressed contact with each other, to form a nip. A sheet S conveyed into the sheet conveyance passage 7*a* by the pickup roller 16 is, while passing through the nip between each pair of conveyance rollers 11, conveyed further downstream in the sheet conveyance passage 7*a*.

The image recording unit 8 is located above the sheet storage unit 4, and is adjacent to the sheet conveyance passage 7*a* in the height direction. The image recording unit 8 includes a conveyance belt 14, a plurality of ink-jet heads 12, and ink tanks.

The conveyance belt 14 is located above the sheet storage unit 4. The conveyance belt 14 is an endless belt stretched around a plurality of rollers including a driving roller. The conveyance belt 14 has a large number of small ventilation holes (not illustrated) formed in it. Inside the conveyance belt 14, a sheet suction unit (not illustrated) that sucks in air through the ventilation holes is provided. A sheet S fed from the sheet conveyance unit 5 is, when it reaches the conveyance belt 14, held on the conveyance belt 14 by suction by the sheet suction unit. In this state the sheet S passes below the image recording unit 8.

The ink-jet heads 12 are disposed opposite the surface of the conveyance belt 14 in the height direction. The ink jet heads 12 are connected respectively to four ink tanks (not illustrated) that separately store inks of four colors (cyan, magenta, yellow, and black). The ink-jet heads 12 are supplied with inks from the ink tanks to which they are connected. The ink-jet heads 12 eject the inks toward the sheet S conveyed in the state held on the conveyance belt 14 by suction.

The reversal conveyance passage 9 is connected to the sheet conveyance passage 7*a* at two places upstream and downstream, respectively, of the image recording unit 8 with respect to the sheet conveyance direction. The reversal conveyance passage 9 branches off the sheet conveyance passage 7*a* downstream of the image recording unit 8, passes above the image recording unit 8, and meets the sheet conveyance passage 7*a* upstream of the image recording unit 8. At a position halfway along the reversal conveyance passage 9 in the sheet conveyance direction, a switchback unit 17 is provided that switches back the conveyance direction of sheets S to reverse their faces.

When images are recorded on both sides of a sheet S, the sheet S having been subjected to image recording on one side is conveyed to the reversal conveyance passage 9, and its conveyance direction is switched (it is switched back). After the obverse and reverse faces of the sheet S are reversed, the sheet S, with its side having no image formed on it yet up, is conveyed back to the image recording unit 8 to be subjected to image recording once again. Having predetermined images recorded on it, one sheet S after another is discharged through a pair of discharge rollers 15 provided near an opening in a downstream end part of the sheet conveyance passage 7*a*.

In a first side surface 18 of the sheet post-processing apparatus 3, that is, its side surface close to the image forming apparatus 1 with respect to the left-right direction, a sheet carry-in port 31 (carry-in port) is provided through which sheets S conveyed from the image forming apparatus 1 are received. Inside the sheet post-processing apparatus 3, there are provided a punch hole forming device 32 that performs a punch hole forming process on sheets S carried in through the sheet carry-in port 31, an end-binding unit 33 that stacks together a plurality of carried-in sheets S to form a sheet bundle and that then, with an end part of the sheet bundle aligned, binds the sheet bundle with a staple, and a middle-binding middle-folding unit 36 that staples a middle part of a sheet bundle and that then folds it along the stapled part into a booklet.

In a second side surface 19 of the image forming apparatus 1, that is, its side surface facing away from the image forming apparatus 1 with respect to the left-right direction, a plurality of sheet discharge openings 30 are formed. The sheet discharge openings 30 are disposed adjacent to each other in the height direction (the direction indicated by arrow L in FIG. 1). Below the sheet discharge openings 30, there are provided a main tray 34, a sub tray 35, and a booklet tray 37 respectively. The main tray 34 (elevating tray) is vertically movable (can ascend and descend) to a position suitable for discharge of a sheet bundle. The sub tray 35 is fixed to an upper part of the sheet post-processing apparatus 3 (above the main tray 34). The booklet tray 37 is fixed to a lower part of the sheet post-processing apparatus 3 (below the main tray 34).

Inside the sheet post-processing apparatus 3, a sheet conveyance passage 7*b* is provided. The sheet conveyance passage 7*b* extends from the sheet carry-in port 31 and on its way branches toward the individual sheet discharge openings 30.

The punch hole forming device 32 is disposed in an upper part of the sheet post-processing apparatus 3. Sheets S discharged from the image forming apparatus 1 are carried in through the sheet carry-in port 31 at the top right of the sheet post-processing apparatus 3, and pass through the punch hole forming device 32. When sheets S having passed through the punch hole forming device 32 are subjected to a stapling process, the sheets S are conveyed to the end-binding unit 33 or the middle-binding middle-folding unit 36 disposed below the punch hole forming device 32. When sheets S having passed through the punch hole forming device 32 are not subjected to a stapling process, the sheets S are discharged onto the sub tray 35 without being conveyed to the end-binding unit 33 or the middle-binding middle-folding unit 36.

The end-binding unit 33 includes a stapler, a processing tray, and the like (none is illustrated). Sheets S are stacked on the processing tray to be formed into a sheet bundle in the form of a bundle. This sheet bundle is, with its tip end aligned, bound in an end part by the stapler provided in an end part of the processing tray, and is then discharged along the processing tray onto the main tray 34. The elevating position of the main tray 34 is controlled in accordance with the height of the booklet stacked on the main tray 34, by a control unit (not illustrated) provided at any place in the image forming system 100.

The middle-binding middle-folding unit 36 for middle binding and middle folding that is disposed below the end-binding unit 33 includes a middle-binding stapler, a middle folding device, a sheet guide, and the like (non is illustrated). The middle-binding stapler staples a middle part of the sheet bundle stacked in the sheet guide. The sheet bundle stabled by the middle-binding stapler is folded along the stapled part into a booklet by the middle folding device, and is then discharged onto the booklet tray 37.

In this way, a predetermined number of sheets fed from the image forming apparatus 1 are conveyed to the sheet post-processing apparatus 3, where they are formed into a sheet bundle in the form of a bundle, which is then subjected to predetermined post-processing to produce a booklet.

Figure 2:
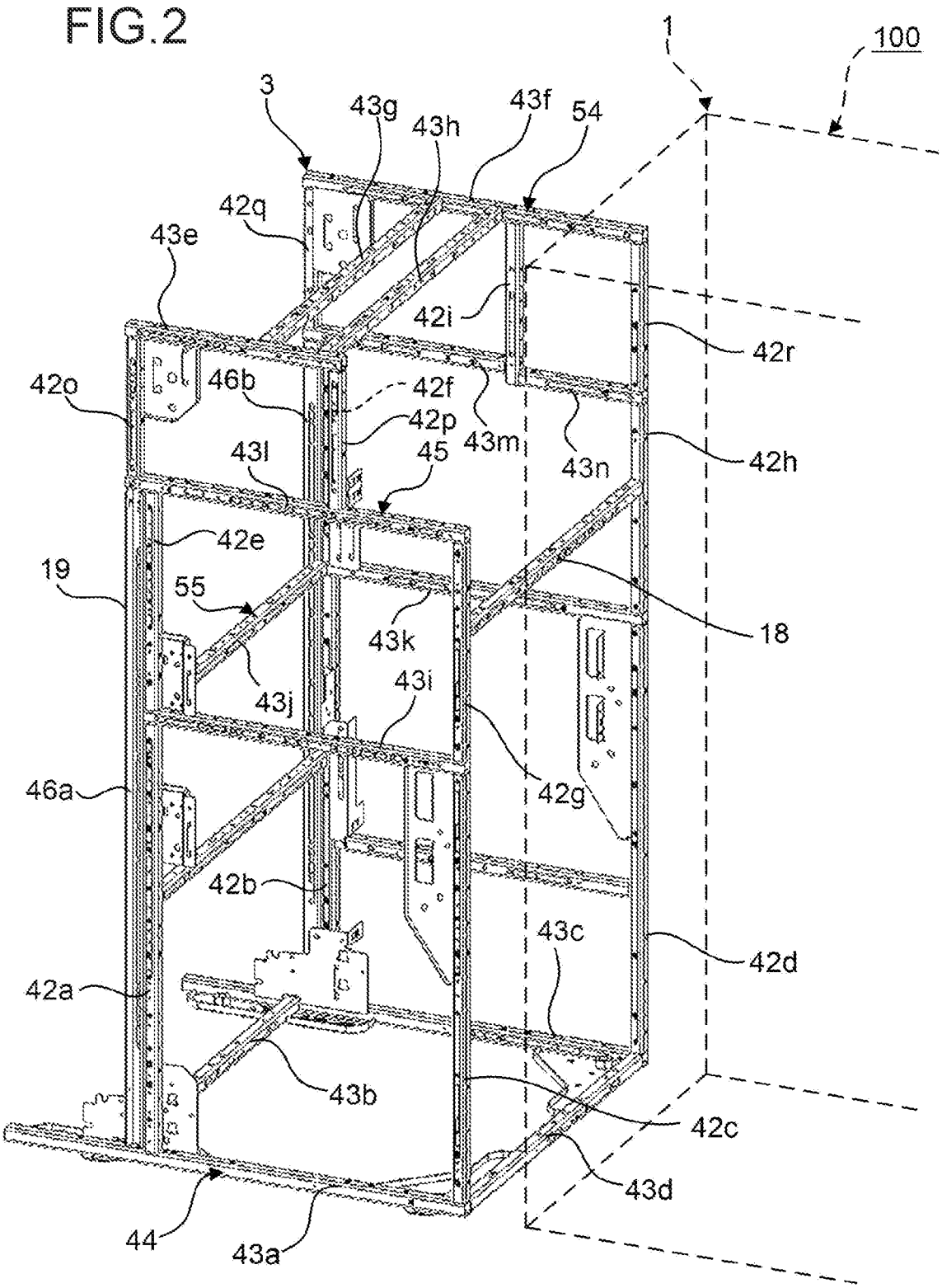
FIG. 2 is a perspective view showing an entire body frame of the sheet post-processing apparatus.

Next, a description will be given of a body frame 41 that constitutes a housing part of the sheet post-processing apparatus 3. FIG. 2 is a perspective view showing the entire body frame 41 of the sheet post-processing apparatus 3.

As shown in FIG. 2, the body frame 41 is composed of vertical frame members 42*a* to 42*r* and horizontal frame members 43*a* to 43*n* combined into a frame in the shape of a rectangular parallelepiped. The body frame 41 supports the side panels, the top panel, and the bottom panel of the sheet post-processing apparatus 3, and thereby constitutes a frame part of the housing of the sheet post-processing apparatus 3. Moreover, the above-mentioned different devices (the punch hole forming device 32, the end-binding unit 33, the main tray 34, and the middle-binding middle-folding unit 36) provided inside the sheet post-processing apparatus 3 are fastened to the body frame 41.

The vertical frame members 42*a* to 42*r* and the horizontal frame members 43*a* to 43*n* are each a pipe member (rectangular pipe) in the shape of a rectangular column with a rectangular cross-sectional shape on a plane orthogonal to its longitudinal direction. The vertical frame members 42*a* to 42*r* and the horizontal frame members 43*a* to 43*n* are formed by cutting identical pipe members, with identical sectional shapes on the plane orthogonal to their longitudinal direction, into different lengths. The vertical frame members 42*a* to 42*r* and the horizontal frame members 43*a* to 43*n* are made of metal (such as aluminum or stainless steel).

The vertical frame members 42*a* to 42*r* are disposed so as to extend along the height direction. The horizontal frame members 43*a* to 43*n* are disposed so as to extend along horizontal directions. Thus, the vertical frame members 42*a* to 42*r* are orthogonal to the horizontal frame members 43*a* to 43*n*. The vertical frame members 42*a* to 42*r* and the horizontal frame members 43*a* to 43*n* are joined together by welding.

A lowest part of the body frame 41 in the height direction is a bottom portion 44. The bottom portion 44 is composed of four horizontal frame members 43*a*, 43*b*, 43*c*, and 43*d* that are joined together to be formed in the shape of a rectangular frame. The bottom portion 44 is, at the four corners, coupled to the vertical frame members 42*a*, 42*b*, 42*c*, and 42*d* extending in the height direction.

An upper end part of the body frame 41 is a top portion 54 composed of horizontal frame members 43*e*, 43*f*, 43*g*, and 43*h*. The top portion 54 faces the bottom portion 44 in the height direction. The horizontal frame members 43*e* and 43*f* in the top portion 54 are parallel to, and are so located as to overlap in the front-rear direction, the horizontal frame members 43*a* and 43*c* in the bottom portion 44. The horizontal frame members 43*g* and 43*h* in the top portion 54 couple together, so as to bridge between, the horizontal frame members 43*e* and 43*f*. The horizontal frame members 43*g* and 43*h* are orthogonal to the horizontal frame members 43*e* and 43*f*.

Between the bottom portion 44 and the top portion 54 with respect to the height direction, a middle portion 55 is formed that is composed of a horizontal frame members 43*i*, 43*j*, and 43*k*. The horizontal frame member 43*i* located at the front of the middle portion 55 couples together, so as to bridge between, upper end parts of the vertical frame members 42*a* and 42*c* adjacent to each other in the left-right direction. The horizontal frame member 43*j* located in a part of the middle portion 55 opposite from the image forming apparatus 1 couples together, so as to bridge between, upper end parts of the vertical frame members 42*a* and 42*b* adjacent to each other in the front-rear direction. The horizontal frame member 43*k* located at the rear of the middle portion 55 couples together, so as to bridge between, upper end parts of the vertical frame members 42*b* and 42*d* adjacent in the left-right direction.

To an end part of the horizontal frame member 43*i* close to the image forming apparatus 1 in the left-right direction, the vertical frame member 42*g* is coupled. The vertical frame members 42*c* and 42*g* are disposed on a straight line with the horizontal frame member 43*i* in between. To an end part of the horizontal frame member 43*i* opposite from the image forming apparatus 1 in the left-right direction, the vertical frame member 42*e* is coupled. The vertical frame members 42*a* and 42*e* are disposed on a straight line with the horizontal frame member 43*i* in between. To an end part of the horizontal frame member 43*k* close to the image forming apparatus 1 in the left-right direction, the vertical frame member 42*h* is coupled. The vertical frame members 42*d* and 42*h* are disposed on a straight line with the horizontal frame member 43*k* in between. To an end part of the horizontal frame member 43*k* opposite from the image forming apparatus 1 in the left-right direction, the vertical frame member 42*f* is coupled. The vertical frame members 42*b* and 42*f* are disposed on a straight line with the horizontal frame member 43*k* in between.

Between the middle portion 55 and the top portion 54, a horizontal reinforcement portion 45 is provided that is composed of the horizontal frame members 43*l*, 43*m*, and 43*n*. The horizontal frame member 43*l* located al the front of the horizontal reinforcement portion 45 couples together, so as to bridge between, upper end parts of the vertical frame members 42*e* and 42*g*. The horizontal frame members 43*m* and 43*n* located at the rear of the horizontal reinforcement portion 45 couple together, so as to bridge between, upper end parts of the vertical frame members 42*f* and 42*h*.

The horizontal frame member 43*m* is coupled to an upper end part of the vertical frame member 42*f*, and extends toward the image forming apparatus 1 in the left-right direction. To an end part of the horizontal frame member 43*m* close to the image forming apparatus 1, a lower end part of the vertical frame member 42*i* is coupled. The horizontal frame member 43*n* is coupled to an upper end part of the vertical frame member 42*h*, and extends away from the image forming apparatus 1 in the left-right direction. To an end part of the horizontal frame member 43*n* away from the image forming apparatus 1, a lower end part of the vertical frame member 42*i* is coupled. The horizontal frame members 43*m* and 43*n* are disposed adjacent to each other with the vertical frame member 42*i* in between. An upper end part of the vertical frame member 42*i* is coupled to the horizontal frame member 43*f* in the top portion 54.

To an end part of the horizontal frame member 43*e* in the top portion 54 opposite from the image forming apparatus 1, the vertical frame member 42*o* extending downward is coupled. To an end part of the horizontal frame member 43*e* close to the image forming apparatus 1, the vertical frame member 42*p* extending downward is coupled. A lower end part of the vertical frame member 42*o* is coupled to an end part of the horizontal frame member 42*l* opposite from the image forming apparatus 1. A lower end part of the vertical frame member 42*p* is coupled to an end part of the horizontal frame member 43*l* close to the image forming apparatus 1.

To an end part of the horizontal frame member 43*f* in the top portion 54 opposite from the image forming apparatus 1, the vertical frame member 42*q* extending downward is coupled. To an end part of the horizontal frame member 43*f* close to the image forming apparatus 1, the vertical frame member 42*r* extending downward is coupled. A lower end part of the vertical frame member 42*q* is coupled to an end part of the horizontal frame member 43*m* opposite from the image forming apparatus 1. A lower end part of the vertical frame member 42*r* is coupled to an end part of the horizontal frame member 42*n* close to the image forming apparatus 1.

Figure 3:
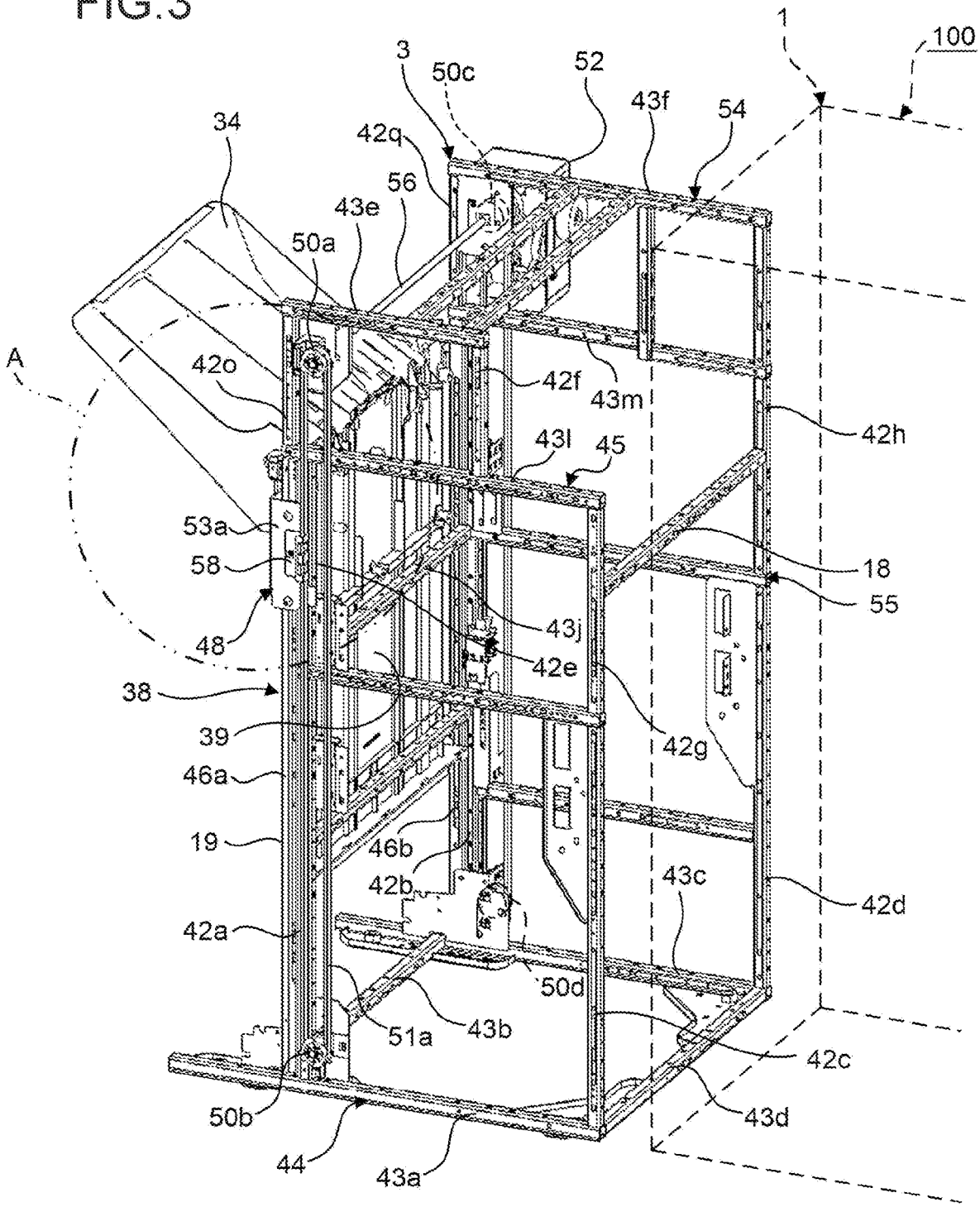
FIG. 3 is a perspective view showing the body frame with a main tray and an elevating unit fitted to it.
Figure 4:
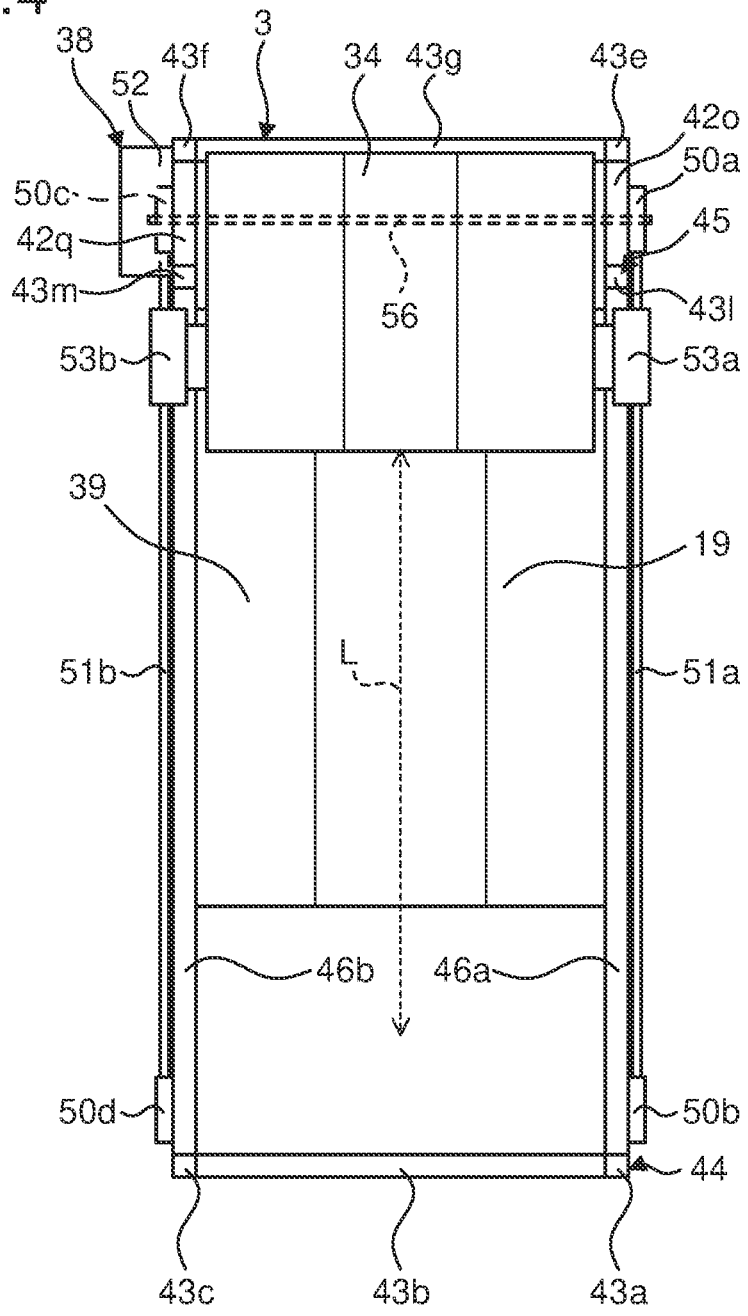
FIG. 4 is a side view of the body frame as seen from the side opposite from the image forming apparatus with respect to the left-right direction.
Figure 5:
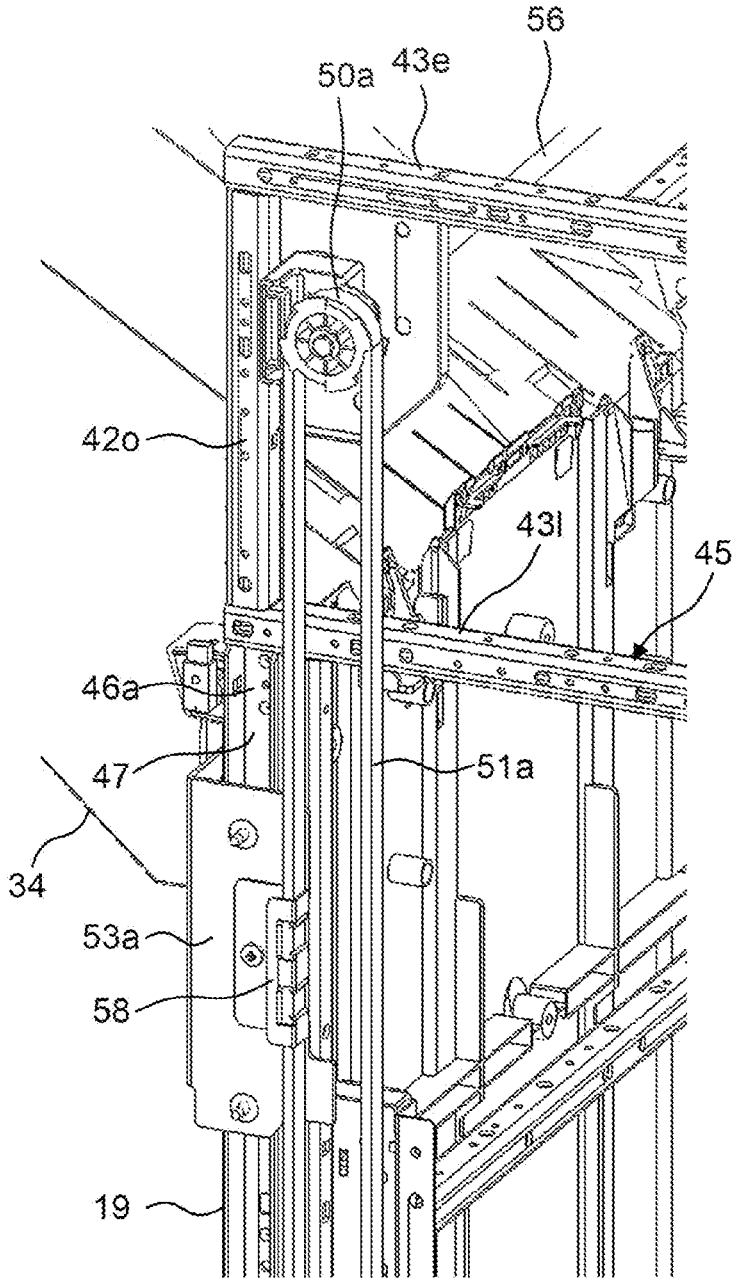
FIG. 5 is an enlarged part view around an elevating mechanism provided on the body frame (inside circle A indicated by a dash-dot-dot line in FIG. 3.
Figure 6:
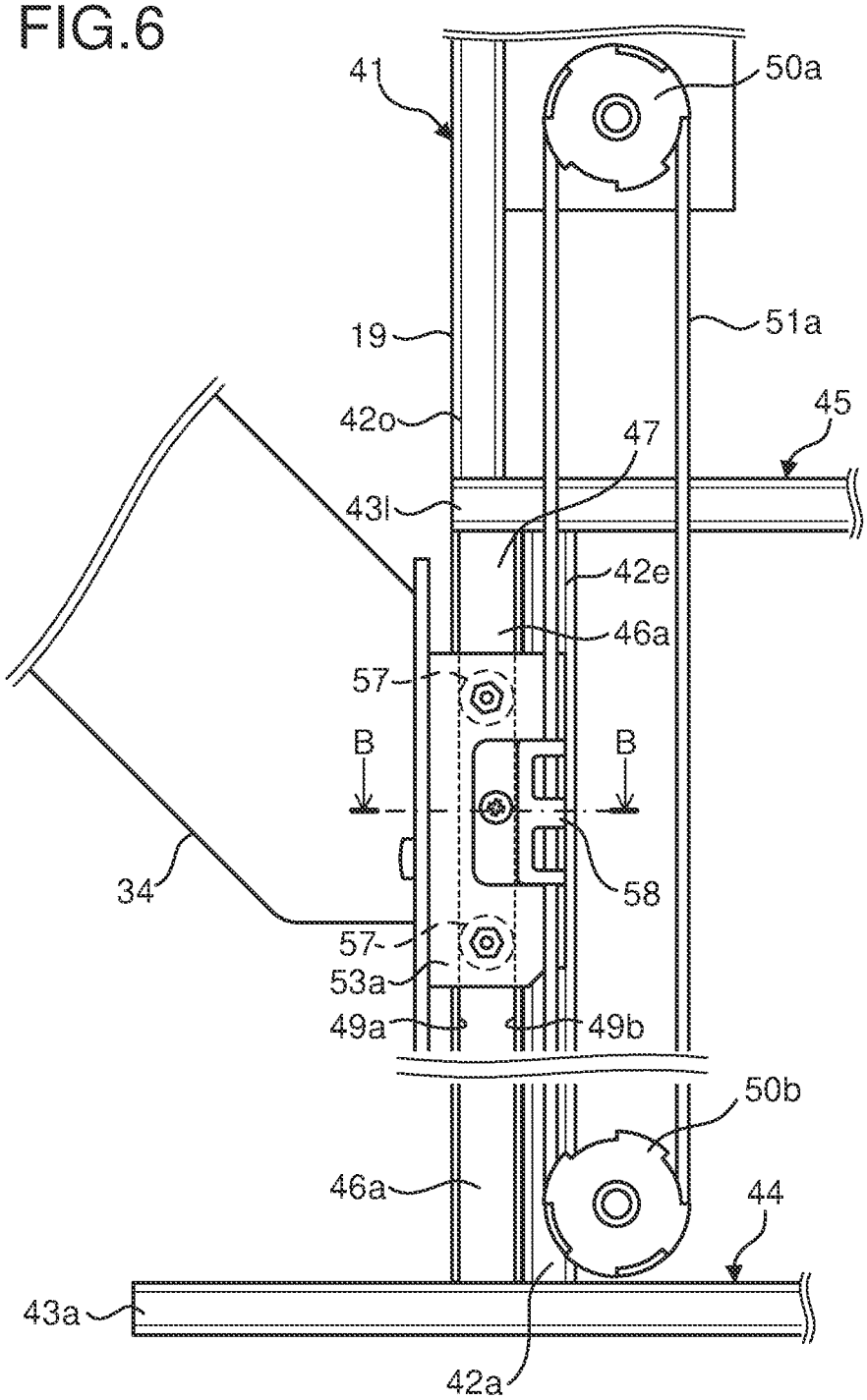
FIG. 6 is an enlarged side view around the elevating mechanism on the body frame.
Figure 7:
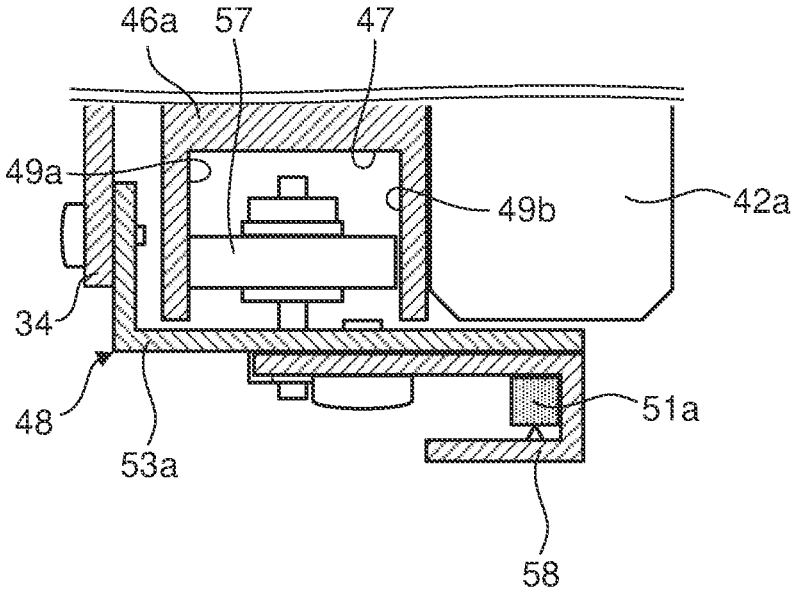
FIG. 7 is a sectional view of the elevating mechanism as cut along section line B-B in FIG. 6.

FIG. 3 is a perspective view showing the body frame 41 with the main tray 34 and an elevating unit 38 fitted to it. FIG. 4 is a side view of the body frame 41 as seen from the side opposite from the image forming apparatus 1 with respect to the left-right direction. FIG. 5 is an enlarged part view around an elevating mechanism 48 provided on the body frame 41 (inside circle A indicated by a dash-dot-dot line in FIG. 3). FIG. 6 is an enlarged side view around the elevating mechanism 48 on the body frame 41. FIG. 7 is a sectional view showing the elevating mechanism 48 as cut along section line B-B in FIG. 6.

As shown in FIGS. 3 and 4, on a side surface of the body frame 41 opposite from the image forming apparatus 1 with respect to the left-right direction, an elevating unit 38 is provided. The elevating unit 38 supports the main tray 34 such that the main tray 34 is vertically movable (can ascend and descend). The elevating unit 38 includes rails 46*a* and 46*b*, mount members 53*a* and 53*b*, and the elevating mechanism 48.

The rails 46*a* and 46*b* are bar-form members that are formed so as to be elongate in the height direction along the vertical frame members 42*a*, 42*b*, 42*e*, and 42*f*. The rails 46*a* and 46*b* couple together, so as to bridge between, the bottom portion 44 and the horizontal reinforcement portion 45 with respect to the height direction. The rail 46*a* is adjacent to the side surfaces of the vertical frame members 42*a* and 42*e* opposite from the image forming apparatus 1 with respect to the left-right direction. An upper end part of the rail 46*a* abuts on an end part of the horizontal frame member 43*l* opposite from the image forming apparatus 1. A lower end part of the rail 46*a* abuts on the horizontal frame member 43*a*. The rail 46*a* and the vertical frame member 42*o* are disposed on a straight line with the horizontal frame member 43*l* in between.

The rail 46*b* is adjacent to the side surfaces of the vertical frame members 42*b* and 42*f* opposite from the image forming apparatus 1. An upper end part of the rail 46*b* abuts on an end part of the horizontal frame member 43*m* opposite from the image forming apparatus 1. A lower end part of the rail 46*b* abuts on the horizontal frame member 43*c*. The rail 46*b* and the vertical frame member 42*q* are disposed on a straight line with the horizontal frame member 43*m* in between.

As shown in FIGS. 5, 6, and 7, the rails 46*a* and 46*b* each have a rail groove 47 formed in it that is recessed inward of the body frame 41 with respect to the front-rear direction and that extends in the height direction. That is, the rails 46*a* and 46*b* each have a U-shaped cross-sectional shape. Each rail groove 47 has, among its inner faces, a pair of guide faces 49*a* and 49*b* that face each other in the left-right direction.

Referring back to FIGS. 3 and 4, the elevating mechanism 48 is provided on the side surface of the body frame 41 opposite from the image forming apparatus 1 with respect to the left-right direction. The elevating mechanism 48 is composed of pulleys 50*a*, 50*b*, 50*c*, and 50*d*, elevating belts 51*b* and 51*b*, a driving device 52 (motor), a rotary shall 56, and the mount members 53*a* and 53*b*.

The pulleys 50*a*, 50*b*, 50*c*, and 50*d* each have a gear surface (not illustrated) formed in its outer circumferential face. The pulley 50*a* is rotatably supported in the corner between the horizontal frame member 43*e* in the top portion 54 and the vertical frame member 42*o*. The pulley 50*b* is rotatably supported in the corner between the horizontal frame member 43*a* in the bottom portion 44 and the vertical frame member 42*a*. The pulleys 50*a* and 50*b* are located at positions that overlap in the front-rear and left-right directions. That is, the pulleys 50*a* and 50*b* are disposed on a straight line along the height direction.

The pulley 50*c* is rotatably supported in the corner between the horizontal frame member 43*f* in the top portion 54 and the vertical frame member 42*q*. The pulley 50*d* is rotatably supported in the corner between the horizontal frame member 43*c* in the bottom portion 44 and the vertical frame member 42*b*. The pulleys 50*c* and 50*d* are located at positions that overlap in the front-rear and left-right directions. That is, the pulleys 50*c* and 50*d* are disposed on a straight line along the height direction.

The elevating belts 51*a* and 51*b* are each an endless belt. The elevating belts 51*a* and 51*b* each have, formed on its inner circumferential face, a gear surface (not illustrated) that is engageable with the gear surfaces on the corresponding ones of the pulleys 50*a*, 50*b*, 50*c*, and 50*d*. The elevating belt 51*a* is stretched between the pulleys 50*a* and 50*b* such that their gear surfaces mesh together. The elevating belt 51*b* is stretched between the pulleys 50*c* and 50*d* such that their gear surfaces mesh together.

The driving device 52 is fastened in the corner between the horizontal frame member 43*f* in the top portion 54 and the vertical frame member 42*p*. The driving device 52 is connected to a power supply unit (not illustrated) and a control unit (not illustrated) that are provided at any places in the image forming system 100, and generates a rotative driving force. The driving device 52 is connected to the pulley 50*c*, and delivers the rotative driving force to the pulley 50*c*.

The rotary shaft 56 couples together, so as to bridge between, the pulleys 50*a* and 50*c*. The rotative driving force delivered to the pulley 50*c* is transmitted via the rotary shall 56 to the pulley 50*a*.

The mount members 53*a* and 53*b* are structured identically; accordingly only the mount member 53*a* will be described below, with no description repeated for the mount member 53*b*.

As shown in FIGS. 5, 6, and 7, the mount member 53*a* is a plate-form member that bends so as to fit a corner of the rail 46*a*. The mount member 53*a* has a holding portion 58 and a roller guide 57 (mount segment). The holding portion 58 holds the elevating belt 51*a* in the front-rear direction. The mount member 53*a* is coupled via the holding portion 58 to the elevating belt 51*a*. The roller guide 57 is a wheel (roller member) that is rotatably supported on the mount member 53*a*. The outer diameter of the roller guide 57 is smaller than the distance across which the guide faces 49*a* and 49*b* face each other.

One of the guide faces 49*a* and 49*b* makes contact with the outer circumferential face of the roller guide 57, and as the roller guide 57 rotates, the mount member 53*a* ascends and descends along the rail grooves 47. As mentioned above, an upper end part of the rail 46*a* is coupled to the horizontal frame member 43*l*, and a lower end part of the rail 46*a* is coupled to the horizontal frame member 43*a*. Thus, the mount member 53*a* can ascend and descend between the horizontal frame member 43*l* in the horizontal reinforcement portion 45 and the horizontal frame member 43*a*.

Referring back to FIGS. 3 and 4, opposite end parts of the main tray 34 in the front-rear direction are coupled to the mount members 53*a* and 53*b*. As the driving device 52 applies a rotative driving force to the pulleys 50*a* and 50*c*, the elevating belts 51*a* and 51*b* rotate to circulates. As the elevating belts 51*a* and 51*b* rotate, the mount members 53*a* and 53*b* and the main tray 34 ascend and descend along the rails 46*a* and 46*b* in the height direction (the direction indicated by arrow L in FIGS. 1 and 4). The control unit of the sheet post-processing apparatus 3 can control the rotative driving force of the driving device 52 and thereby adjust the position of the main tray 34 in the height direction.

On the side surface (second side surface 19) of the body frame 41 opposite from the image forming apparatus 1 with respect to the left-right direction, a side plate 39 is provided. The side plate 39 is a plate-form member that is formed by working sheet metal. The side plate 39 is coupled to the horizontal frame member 43*j* and the rails 46*a* and 46*b* so as to bridge between the rails 46*a* and 46*b* in the front-rear direction. The side plate 39 faces the main tray 34 in the left-right direction.

As described above, the body frame 41 is composed of the horizontal frame members 43*a* to 43*n* and the vertical frame members 42*a* to 42*r*. Thus, the body frame 41 is composed of a comparatively small number of components. The comparatively small number of components helps suppress lessening of ease of assembly of the body frame 41. It is thus possible to provide a sheet post-processing apparatus 3 that can suppress an increase in manufacturing cost.

Moreover, as described above, the rails 46*a* and 46*b* couple together, so as to bridge between, the bottom portion 44 and the horizontal reinforcement portion 45. Thus, the rails 46*a* and 46*b* give the body frame 41 comparatively high rigidity.

Moreover, as described above, the vertical frame members 42 and the horizontal frame members 43 are formed of identical members. This helps standardize components and helps further reduce manufacturing cost.

Moreover, as described above, the vertical frame members 42*a* to 42*r* and the horizontal frame members 43*a* to 43*n* are each formed as a pipe member in the shape of a rectangular column. Thus, the vertical frame members 42*a* to 42*r* and the horizontal frame members 43*a* to 43*n* each have comparatively high rigidity. This helps give the body frame 41 comparatively high rigidity.

Incidentally, in a common sheet post-processing apparatus, the frame members that constitute the skeleton of its housing are each a plate-form sheet-metal member, and are joined together with fastening members such as bolts. Accordingly, in the assembly of the sheet post-processing apparatus, screw fastening is required at multiple places, and this may lead to lessened ease of assembly. Also the fastening members that keep the frame members joined together after assembly may loosen with time due to vibration and the like during the operation of the sheet post-processing apparatus, and this may lead to reduced rigidity of the housing of the sheet post-processing apparatus.

By contrast, in the sheet post-processing apparatus 3 according to the present disclosure, as described above, the body frame 41 is composed of the vertical frame members 42*a* to 42*r* and the horizontal frame members 43*a* to 43*n*, all made of metal, joined together by welding. Thus the body frame 41 can be welded and assembled on an automated production line, and this helps suppress lessening of ease of assembly. Moreover, forming the body frame 41 by welding together the vertical frame members 42*a* to 42*r* and the horizontal frame members 43*a* to 43*n* helps suppress deterioration of the body frame 41 due to vibration and the like, and helps suppress a drop in the rigidity of the body frame 41.

The present disclosure is not limited to the embodiment specifically described above and allows for many modifications without departure from the spirit of the present disclosure. For example, while in the embodiment described above the image forming system 100 has a configuration where the sheet post-processing apparatus 3 is coupled directly to the image forming apparatus 1, a configuration is also possible where an insertion apparatus that permits insertion of insert sheets such as cover sheets is arranged between the sheet post-processing apparatus 3 and the image forming apparatus 1. With this configuration, it is possible to insert a front cover, middle inserts, a back cover, and the like in a booklet produced by the image forming system 100.

While in the embodiment described above a construction is adopted where the mount members 53*a* and 53*b* ascend and descend along the rails 46*a* and 46*b* as the rotatably supported roller guide 57 rotates, this is not meant as any limitation. For example, a construction is also possible where, instead of the roller guide 57, a guide projection is provided that projects into the rail groove 47 from each of the mount members 53*a* and 53*b*. In that case, the guide projection slides on at least one of the guide faces 49*a* and 49*b* so that the mount members 53*a* and 53*b* ascend and descend along the rails 46*a* and 46*b*. This helps reduce the number of components in the mount members 53*a* and 53*b*, it is thus possible to suppress an increase in manufacturing cost.

Figure 8:
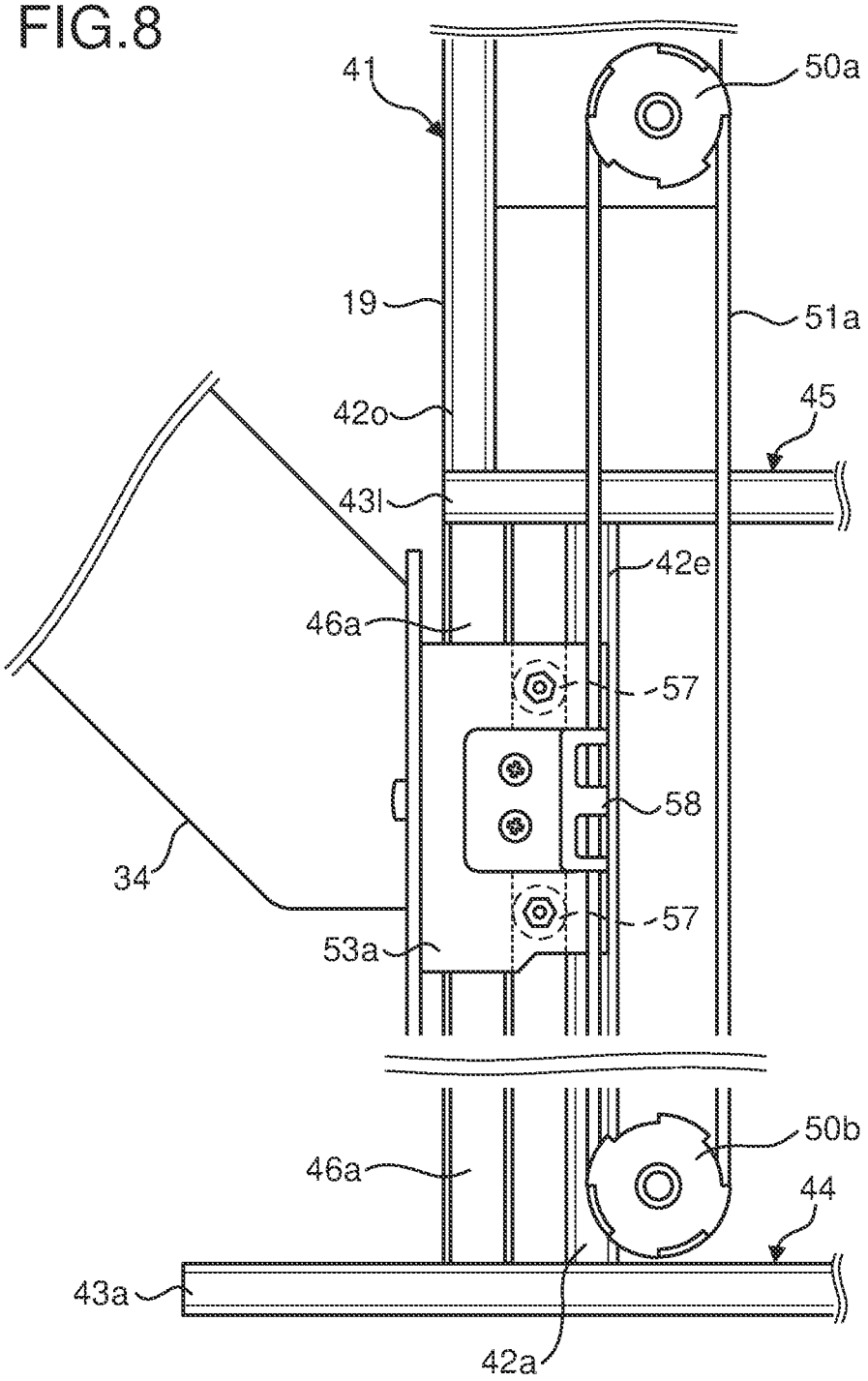
FIG. 8 is a plan view showing a modified example of the sheet post-processing apparatus according to the present disclosure.

A construction is possible where, as shown in FIG. 8, a gap is left between the rail 46*a* and the vertical frame members 42*a* and 42*e* with respect to the left-right direction and the roller guide 57 makes contact with either a side surface of the rail 46*a* or a side surface of the vertical frame members 42*a* and 42*e*. The same applies to the rail 46*b*. This eliminates the need to provide the rail groove 47 in the rails 46*a* and 46*b*, and helps suppress an increase in the production cost of the rails 46*a* and 46*b*. Moreover, in that case, the rails 46*a* and 46*b* can be formed of members identical with the vertical frame members 42*a* to 42*r*, and this helps further suppress an increase in the manufacturing cost of the body frame 41.

A construction is possible where, the rail groove 47 is formed in the vertical frame members 42*a* and 42*b* instead of in the rails 46*a* and 46*b*. This helps further reduce the number of components of the body frame 41.

By use of a plurality of vertical frame members 42*a* to 42*r* and horizontal frame members 43*a* to 43*n* as described above, it is possible to construct a frame for a body part of not only a sheet post-processing apparatus as described above but also an image forming apparatus 1 or any other electronic apparatus.

By applying the present disclosure to an image forming system including a sheet post-processing apparatus that performs post-processing such as a biding process on sheets having images formed on them by an image forming apparatus, it is possible to suppress an increase in the manufacturing cost of the image forming system.

What is claimed is:

1. A sheet post-processing apparatus that receives a sheet discharged from an upstream apparatus and that performs predetermined post-processing on the sheet, the sheet post-processing apparatus comprising:

an apparatus body;

a body frame that constitutes a frame of the apparatus body;

a sheet conveyance passage through which the sheet is conveyed from a carry-in port provided in a first side surface of the apparatus body to a carry-out port provided in a second side surface of the apparatus body opposite from the first side surface;

an elevating tray configured to ascend and descend along the second side surface and stack the sheet discharged from the carry-out port stacked; and an elevating unit that makes the elevating tray ascend and descend, wherein the elevating unit includes a pair of rails that are provided on the body frame and that guide ascent and descent of the elevating tray, the body frame includes:

a plurality of vertical frame members that extends in a vertical direction and a plurality of horizontal frame members that extends in a horizontal direction and is joined by welding to the plurality of vertical frame members, the pair of rails are formed integrally with among the plurality of vertical frame members, a pair of vertical frame members provided corresponding to the second side surface, the horizontal frame members and the vertical frame members are rectangular pipes made of metal and having a rectangular cross-sectional shape on a plane orthogonal to a longitudinal direction and the horizontal frame members and the vertical frame members are joined together by welding.

2. The sheet post-processing apparatus according to claim 1, wherein the elevating unit further includes:

a pair of endless elevating belts that circulates in a vertical direction along the pair of vertical frame members;

a pair of pulleys that are disposed opposite each other in vertical direction and around which the elevating belts are stretched;

a motor that rotates the pair of pulleys;

a pair of mount members that is fitted to the pair of elevating belts and that supports the elevating tray, and the pair of mount members has mount segments that are fastened to the pair of elevating belts and the mount segments move along the pair of rails.

3. The sheet post-processing apparatus according to claim 2, wherein the pair of rails are grooves with U-shaped cross-section formed in outer side surfaces of the pair of vertical frame members in a width direction orthogonal to a conveyance direction of the sheet, the grooves being recessed in the width direction, and the mount segments are guided along inner wall faces of the pair of rails to ascend and descend in the vertical direction.

4. The sheet post-processing apparatus according to claim 3, wherein the mount segments respectively have roller members that are slidable on the inner wall faces of the pair of rails.

5. An image forming system comprising:

an image forming apparatus that includes an image forming unit for forming an image on the sheet and that discharges downstream the sheet having the image formed thereon; and the sheet post-processing apparatus according to claim 1 that is connected to the image forming apparatus.

6. An electronic apparatus comprising:

an apparatus body in a shape of a rectangular parallelepiped;

a body frame that constitutes a skeleton of the apparatus body;

an elevating member that is provided on one side surface of the apparatus body and that ascends and descends along the one side surface; and an elevating unit that makes the elevating member ascend and descend, wherein the body frame includes vertical frame members and horizontal frame members that are hollow and that are joined together by welding, the elevating unit includes a pair of rails that are formed on the vertical frame members provided on the one side surface and that guide ascent and descent of the elevating member, and of the vertical frame members, a pair of vertical frame members disposed corresponding to one side surface of the apparatus body have the pair of rails formed integrally therewith.

* * * * *